United States Patent [19]

Louis et al.

[11] Patent Number: 4,754,690

[45] Date of Patent: Jul. 5, 1988

[54] ELECTRICALLY CONTROLLED HYDRAULICALLY DRIVEN ACTUATOR ASSEMBLY

[75] Inventors: Ronald J. Louis, Phoenix; Leslie S. Terp, Scottsdale, both of Ariz.

[73] Assignee: Allied-Signal Inc., Morris Township; Morris County, N.J.

[21] Appl. No.: 909,381

[22] Filed: Sep. 19, 1986

[51] Int. Cl.[4] ..... F15B 13/02

[52] U.S. Cl. ..... 91/51; 137/82; 251/129.2

[58] Field of Search ..... 91/51, 47, 48, 50, 459; 417/505, 510; 137/82, 625.64, 625.61; 251/129.2, 129.1, 902, 301

[56] References Cited

U.S. PATENT DOCUMENTS

| | | | |
|---|---|---|---|
| 2,601,867 | 7/1952 | Alyea . | |
| 2,709,421 | 5/1955 | Avery . | |
| 2,832,365 | 4/1953 | Smith . | |
| 2,879,467 | 3/1959 | Stern . | |
| 2,912,008 | 11/1959 | Blackburn . | |
| 2,915,077 | 12/1959 | Wehrli et al. . | |
| 2,924,241 | 2/1960 | Bauer . | |
| 2,977,985 | 4/1961 | Ericson et al. . | |
| 2,983,278 | 5/1961 | Heintz | 91/51 X |
| 3,026,892 | 3/1962 | Tsien . | |
| 3,062,235 | 11/1962 | Lucien | 137/82 X |
| 3,167,632 | 1/1965 | O'Connor . | |
| 3,215,162 | 11/1965 | Carver | 137/625.44 |
| 3,537,355 | 11/1970 | Bliss | 91/51 |
| 3,757,822 | 6/1972 | Kell . | |
| 3,964,518 | 6/1976 | Hesse et al. | 91/51 |
| 4,138,089 | 2/1979 | McCarthy . | |

FOREIGN PATENT DOCUMENTS

| | | |
|---|---|---|
| 492292 | 2/1930 | Fed. Rep. of Germany . |
| 2044961 | 10/1980 | United Kingdom . |

*Primary Examiner*—Edward K. Look

*Attorney, Agent, or Firm*—R. Steven Linne; James W. McFarland

[57] ABSTRACT

An electrically controlled, fluid driven actuator valve, in which an electrical signal drives a solenoid, which at any one time operates one of two flexible valve elements which, when opened causes a fluid pressure differential in a piston like hydraulic actuator chamber, to thereby drive an actuator rod, which then acts on any device desired to be controlled. The valve is of simple design with a minimum of moving parts, and is especially useful in missile and aircraft applications.

19 Claims, 1 Drawing Sheet

ELECTRICALLY CONTROLLED HYDRAULICALLY DRIVEN ACTUATOR ASSEMBLY

BACKGROUND OF THE INVENTION

This invention relates generally to electro-fluid servo systems and methods, and particularly to such systems wherein a relatively weak electric signal is tranformed to a relatively strong mechanical force.

Electro-fluid control valves are usually employed in instances where remote control of mechnical acton is needed, and where space, weight, and power limitations prohibit using the same form of energy for control as is used for the prime mover of mechanical action. For example, in modern aircraft, including jet aircraft and missile type aircraft, fluid devices are used to move the airfoil control surfaces. Most applications for electro-fluid control devices use only liquid hydraulic fluid (electro-hydraulic), and occur in instances where not all of the above enumerated restrictions are encountered simultaneously. In some larger systems, the control logic may be hydraulic, and built into the valve itself, eliminating the need for external sensing/control devices. The usual type of known electro-hydraulic control valve may involve the use of a dual hydraulic amplifier system where a separate lower pressure hydraulic system causes a spool valve to shift, and the spool valve releases or closes off a higher pressure hydraulic source then causing the higher pressure hydraulic source to be used in a piston. The requirement for a secondary hydraulic system is cumbersome, and if provision must stll be made for the electric signal to first control the weak hydraulic system, the result is a bulky, three tier system. Also, using a weak hydraulic system for control of a stronger hydraulic system will limit the actuator valve of the secondary hydraulic system to a weaker pressure drop with which to move the primary high pressure controlling hydraulic valve element, thus making control less responsive. Other types of known electro-hydraulic control valves use springs to urge the main controlled valve element away from its non-neutral positions, or contain a good number of moving parts. Other electro-hydraulic control valves are arranged such that the rate of mechanical movement is dependent on the strength of the magnetic field produced in the control coils. Either of these systems may fall out of balance if the magnetically actuated element becomes permanently magnetized, or if the strength of the signal reaching the control coils becomes out of balance through extended use, or if the springs become fatigued.

In modern aircraft, including jet aircraft and missile type aircraft, a responsive electro-mechnical servo controller is needed to convert movement commands supplied in the form of electrical signals, into mechanical motion for controlling parts of the aircraft, the flight control surfaces being the most notable example. The most desirable characteristics in such a control system include, but are by no means exhaustive, light weight, quick response, fewer moving parts to reduce wear, maximum degree of control and the ability to function in the hostile aircraft environment. Elements of this aircraft environment include extreme heat produced by Aircraft engines which is passed on by conduction and radiation to nearby devices, and gravitational acceleration forces which may affect the performance of moving parts.

SUMMARY OF THE INVENTION

The present invention, an electrically controlled fluid driven actuator, is a lightweight integrated unit using a single source of fluid supply (gas or liquid) and is designed to meet the space, weight, and power limitations present in an aircraft environment. The body of the device houses a solenoid, a pair of flexible valve elements, and the actuator drive rod, these elements constituting the moving parts of the device. The solenoid will preferably have a short powerful stroke. Energization of the solenoid in one direction causes one of the flexible valve elements to bend away from the solenoid armature, thus bending the tip of the flex wand element out of the path of a flow channel to allow the liquid, whose flow was impeded when the flexible valve element was at rest, to flow freely into the valve element support cylinder. In the preferred embodiment, the flexible valve elements do not contact the flow channel, either at rest, or in the flexed position, thus eliminating a potential source of metal wear. Once the fluid begins to flow, the pressure of one of the two chambers of the divided actuator cavity begins to drop, since it is in fluid communication with the now flowing fluid. Since the fluid pressure on the other, non-draining chamber of the actuator cavity is now higher than the pressure of the chamber affected by the draining fluid, and since the non-draining chamber is still in direct pressurizing communication with the source of the source control fluid, the actuator rod moves in the direction of the pressure gradient. When the solenoid is de-energized, the resilient flexible valve element springs back to its unflexed position, again blocking the path of the flow channel, while urging the solenoid armature back to its neutral position. Once the flow of both the channels are equally impeded, the actuator rod ceases moving. A cross channel allows both chambers of the actuator cavity to be in restricted flow fluid communication. The duration of energization of the solenoid determines the amount of linear displacement of the actuator rod. When the solenoid is de-energized, the actuator rod remains stationary. When the solenoid is energized in the other direction, the actuator rod is displaced in the opposite direction.

An object of the present invention is to provide a quick response electro-mechanical control device and method of compact, lightweight construction by virtue of directly driving a relatively high pressure fluid flow valve by using a very lightweight solenoid armature, flexible valve element and actuator drive chamber. A further object is the use of the invention with computer control, often present in many aircraft, which will allow the designation of a given amount of displacement to be translated directly into a time duration of energization for the solenoid, taking to account all of the characteristics of the device including but not limited to inductance of the solenoid coils, size and number of windings of the coils, physical dimensions of the coils, the solenoid armature stroke, the time to full flex of the flexible valve elements, and the size of the fluid channels and pressure of the fluid therein. The short stroke of the solenoid will allow for a more exactly defined control of the on/off state of the flexible valve element.

A further object of the invention is to provide an improved electro-fluid control device and method in accord with the preceding object whose compact configuration and heat dissipating capability renders it suitable for utilizing fuel at the hydraulic control fluid.

A further object of the invention is to provide an improved electro-fluid control device and method of simplest design and lightweight construction. The use of a direct valving link to control the power fluid, thus eliminating the need for a more complicated, heavier intermediate valve arrangement, directly assists in attaining these desired characteristics. Also, when the present invention is used with a high pressure fluid which is already present in the system rather than a separate closed conventional fluid system, the required system weight is decreased, since a separate fluid system, usually with its associated pumps, lines, pressure regulators, etc., is not needed. The use of fuel, as a pressurized fluid supply, on its way to the combustion chamber will assist the device in dissipating heat absorbed due to its proximity to heat sources, such as an engine on a jet aircraft or combustion chamber on a missile.

A further object of the invention is to provide an improved electro-fluid control device whose operation will not be affected by exposure to extreme inertial forces such as those encountered in modern aircraft during sharp turns and coming out of dives. The high response, low inertia solenoid has a light weight solenoid armature held in place by the resilient, light weight flexible valve elements and are especially resistive of these inertial forces. The short stroke of the solenoid armature, which will allow total displacement at lower solenoid coil current, will also allow the flexible valve elements have a stronger springing characteristic to thereby further reduce the device's susceptance to being affected by inertial force.

A further object of the invention is to provide an improved electro-fluid control device with few moving parts to give long service with the little maintenance. The resilient flexible valve elements should require less maintenance than other types of valve elements, because they do not contact the flow channel. The moving parts include only the solenoid armature, flexible valve elements, and actuator rod.

A further object of the invention is to provide an improved electro-fluid control device which insures that the control fluid is kept isolated from both the solenoid and the environment external to the device by the use of drainage channels, the openings of which are situated between the inner and outer sealing surfaces, to catch any fluid seeping through the first set of seals and directing it to the drainage port. The present device also minimizes fluid circulation, and thus lost energy, when the control solenoid is in its de-energized state.

BRIEF DESCRIPTION OF THE DRAWINGS

Further objects and advantages of the invention will become apparent from the following description and claims, and from the accompanying drawings, wherein:

DESCRIPTION OF THE PREFERRED EMBODIMENT

Figures 1, 2:
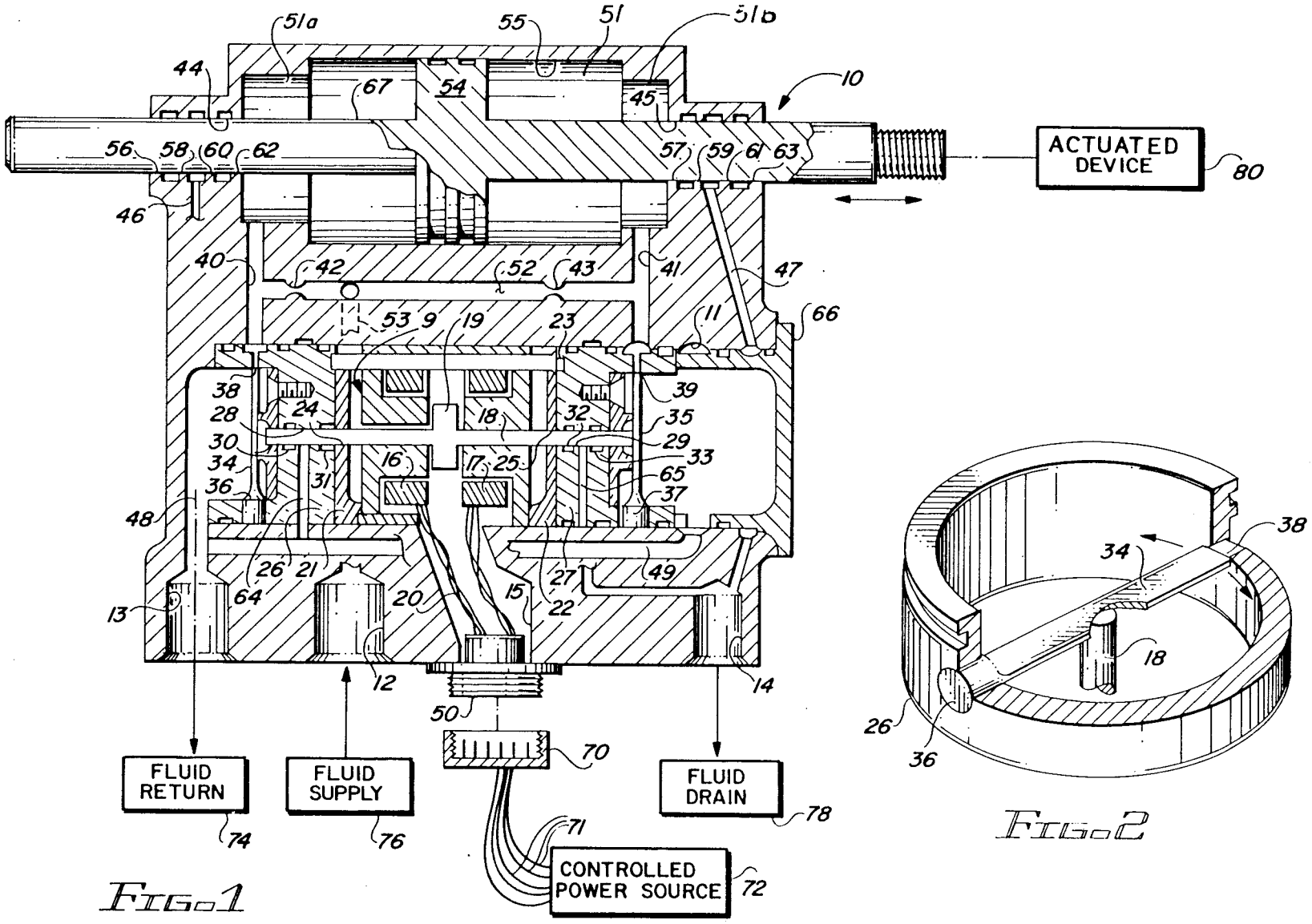
FIG. 1 is a cross-sectional view of the invention showing the improved solenoid assembly constructed in accordance with the principles of the present invention.
FIG. 2 is a perspective view showing the inner cylindrical surface of the retaining wall illustrating an enlarged view of the flexible valve element.

Referring to FIG. 1, the electro-fluid actuator valve has a body 10 with an elongated closed end central cavity 11 formed in body 10. Within the center of cavity 11 is positioned the electrical actuating assembly generally designated 9. The electrical actuating assembly 9 is made up of solenoid armature 18 having an enlarged land 19 formed at its center to enhance its ability to become motivated axially due to magnetic force produced in either of the solenoid coils 16 or 17. Plate 21 abuts solenoid coil 16 and is provided with hole 24 near its center, through which the left half of solenoid armature 18 extends. Plate 22 abuts solenoid coil 17 and is provided with hole 25 near its center, through which the right half of solenoid armature 18 extends. One or more bolts generally designated 23 join plates 21 and 22 in a sandwich fashion together with solenoid armature 18 to form the electrical actuating assembly 9. Wires 20 are electrically connected to solenoid coils 16 and 17 to carry current for energizing either solenoid coil 16, or solenoid coil 17. Wires extend from solenoid coils 16 and 17 through electrical command port 15 formed within body 10 and in usual practice will terminate at an electrical connector 50 usually attached to body 10 to allow quick connection/disconnection to a compatible connector 70 for ease of installation and removal. Wires 71 connect to connector 70 and to controlled power source 72. Controlled power source 72 can be simple, as in the case of a direct current source controlled with manual switches, or more complex as in the case of a computer controlled current relay system. The wires 20 and 71, electrical connectors 50 and 70 will be specified to be of sufficient size to handle the amperage requirement of solenoid coils 16 and 17.

Abutting the electrical actuating assembly 9 within central cavity 11, are a pair of valve element support cylinders 26 and 27, each having an open end, the open ends being disposed outwardly with respect to electrical actuating assembly 9, and whose outer surface of the closed ends each abuts plates 21 and 22 respectively. The axis of valve element support cylinders 26 and 27 is collinear with the axis of solenoid armature 18. Aperture 28 is provided in valve element support cylinder 26, and aperture 29 is provided in valve element support cylinder 27 to slidably permit the left end and right end, respectively of solenoid armature 18, to extend therethrough. Within aperture 28, each near one end of aperture 28, are placed seals 30 and 31, to form a fluid seal within the annular space formed between the left end of solenoid armature 18 and the inner cyindrical surface of aperture 28, in order to prevent fluid reaching the electrical actuating assembly 9. Similarly, within aperture 29, each near one end of aperture 29, are placed seals 32 and 33, to form a fluid seal within the annular space formed between the right end of solenoid armature 18 and the inner cylindrical surface of aperture 29, in order to prevent fluid reaching the electrical actuating assembly 9.

Within the curved wall of valve element support cylinder 26, is fixedly attached flexible valve element 34, the axis of flexible valve element 34 perpendicular to the axis of valve element support cylinder 26. Referring to FIG. 2, wherein a section of the valve element support cylinder 26 is rotated ninety degrees clockwise, flexible valve element 34 extends across the interior diameter of valve element support cylinder 26. The flexible valve element 34 has an enlarged base 36 which is rigidly fixed within the wall of valve element support cylinder 26 by press fitting and electron beam welding it into place, or other equally acceptable means. Flexible valve element 34 is illustrated in its non-flexed state abuting the left end of solenoid armature 18. The tip of flexible valve element 34 obstructs flex valve aperture 38, the greater degree of obstruction obtainable if the area of the end of flexible valve element 34 is equal or greater than the cross sectional area of flex valve aperture 38. The tip of flexible valve element 34 does not extend into flex valve aperture 38, and is free to swing its tip in an arcing manner across the opening of flex valve aperture 38.

Referring again to FIG. 1, similar to flexible valve element 34, within the curved wall of valve element support cylinder 27, is fixedly attached flexible valve element 35, the axis of flexible valve element 35 perpendicular to the axis of valve element support cylinder 27. Flexible valve element 35 extends across the interior diameter of valve element support cylinder 27. The flexible valve element 35 has an enlarged base 37 which is rigidly fixed within the wall of valve element support cylinder 27 in the same manner as flexible valve element 35 was attached to valve element support cylinder 26, as recited above. Flexible valve element 35 abuts the right end of solenoid armature 18. The tip of flexible valve element 35 obstructs flex valve aperture 39, in the same manner as flexible valve element 34 obstructs flex valve aperture 38 as recited above.

Valve element support cylinder 26 is positioned within central cavity 11 such that flex valve aperture 38 is in communication and alignment with flow channel 40, which extends into actuator cavity, generally designated 51. The open end of valve element support cylinder 26 communicates with return port 13 through return channel 48, to return fluid valved into valve element support cylinder 26 to the fluid return 74. The fluid return 74 may recycle the fluid, expel it, or send it to a final destination. Likewise, valve element support cylinder 27 is positioned within central cavity 11 such that flex valve aperture 39 is in communication and alignment with flow channel 41, which also extends into the actuator cavity, generally designated as 51. The open end of valve element support cylinder 27 communicates with exit port 13 through return channel 49, to return fluid valved into valve element support cylinder 27 into fluid return 74.

End cap 66 fits sealingly within central cavity 11 to enclose valve element support cylinder 26, electrical actuating assembly 9, and valve element support cylinder 27 all within body 10, keeping fluid entering valve element support cylinder 27 from escaping to the outside.

Flow channels 40 and 41 are joined by cross channel 52. Near end each of cross channel 52 is located flow restriction 42 and flow restriction 43. Between the restrictions 42 and 43, cross channel 52 is joined by supply channel 53. Supply channel 53 provides an entrance for hydraulic fluid to flow into body 10 through supply port 12 from fluid supply 76 which can be any source of fluid supply including but not limited to a pump, compressor, or pressurized vessel.

Actuator cavity 51 is fitted to slidably contain actuator drive rod 67. Actuator drive rod 67 extends through and is sealably and slidably supported near one end by aperture 44 formed in body 10, and extends through, and is sealably and slidably supported near the other end by aperture 45 in body 10. A radially enlarged land 54 is formed at the center of actuator drive rod 67, the land 54 in slidable sealing contact with the wall 55 of actuator cavity 51. The land 54 segregates the actuator cavity 51 into two chambers, 51*a* on the left side of land 54, and 51*b* on the right side of land 54. Land 54 serves as a piston with respect to actuator cavity 51, such that if one chamber experiences a pressure greater than the other chamber, land 54, together with actuator drive rod 67 will slidably move toward the chamber with the lower pressure, and away from the chamber with the higher pressure. The ends of actuator drive rod 67 may be attached to any device desired to be driven by the present invention, shown schematically in FIG. 1 as actuated device 80.

Two pairs of seals, namely seals 56 and 58, and seals 60 and 62 are located within the inner surface of aperture 44 to form sealing engagement with the left side of actuator drive rod 67, to prevent fluid escaping chamber 51*a* through the annular space formed between aperture 44 and actuator drive rod 67, to the outside of body 10. Similarly, another two pairs of seals, namely seals 57 and 59, and seals 61 and 63 are located within the inner surface of aperture 45 to form sealing engagement with the right side of actuator drive rod 67, to prevent fluid escaping from chamber 51*b* through the annular space formed between aperture 45 and actuator drive rod 67, to the outside of body 10.

A series of seal drainage channels 46, 47, 64, and 65 are formed integrally within body 10 to aid in containing control fluid seepage. Seal drainage channel 46 communicates with the annular space between seal 58 and seals 60, to drain away any fluid which leaks from the chamber 51*a*, past seal 60 and 62, before it reaches seal 58 and 56. Similarly, seal drainage channel 47 communicates with the annular space between seal 59 and seal 61, to drain away any fluid which leaks from the chamber 51*b*, past seal 57 and 59, before it reaches seal 61 and 63. Seal drainage channel 64 is formed integrally within valve element support cylinder 26, and communicates with aperture 28, in the annular space between seal 30 and 31, to aid in containment of any fluid from within valve element support cylinder 26 seeping past seal 30 before it reaches seal 31. Similarly, seal drainage channel 65 is formed integrally within valve element support cylinder 27, and communicates with aperture 29, in the annular space between seal 32 and 33, to aid in containment of any fluid from within valve element support cylinder 26, seeping past seal 33 before it reaches seal 32. Drainage channels 46, 47, 64, and 65 all connect to drainage port 14, formed integrally with body 10, to remove seal seepage fluid from the present invention to any device equipped to collect drainage, schematically shown as fluid drain 78 on FIG. 1.

In normal operation of the present invention, a fluid, such as a conventional commercial hydraulic fluid, or if circumstances require, engine fuel, is provided under pressure from any source, generally designated fluid supply 76, through supply port 12, which continues through to supply channel 53, and cross channel 52, all of which are in fluid communication with supply port 12. The fluid then continues on to flow channels 40 and 41, and the respective chambers 51*a* and 51*b* of actuator cavity 51 in which each of the flow channels 40 and 41 is in fluid communication with. If both flexible valve elements 34 and 35 are in their closed (unflexed) position, the fluid pressure in both the left and right side of the land 54 of actuator drive rod 67 will be equal, and the actuator drive rod 67 will tend to stay at rest. Actuator drive rod 67 will resist movement, since for movement to occur when flex wand valve elements 34 and 35 are closed, fluid would be forced to move, for example, from chamber 51*a* to chamber 51*b* through flow channel 40, the flow restriction 42, cross channel 52, flow restriction 43, and finally flow channel 41, before reaching chamber 51*b*, thus presenting a significant barrier to movement when the present invention is in a non-actuated state. It is contemplated that the tolerance of manufacture of the present device may be such that, in the closed position, the fluid may continuously leak around the flexible valve elements 34 and 35 at the point where they obstruct flex valve apertures 38 and 39 respectively. This fluid then passes through either return channel 48 or return channel 49, and then to return port 13, and then to fluid return 74. This "leaky" nature, mentioned above, will allow the present invention to remove buildup of heat, occasioned by proximity to a high temperature source, by transferring it to a small stream of control fluid which then leaves the device.

When it is desired to actuate the device, to move the actuator drive rod 67 in one direction or the other, an electrical current is sent from controlled power source 72, through transmission wires 71 to an electrical connector 70 compatible with and capable of being connected to electrical connector 50, then through wires 20 located within electrical command port 15, and then on to solenoid coils 16 or 17. It is contemplated that either solenoid coil 16 or 17 will be energized at any one time, but usually not both at once. Assuming solenoid coil 16 is energized, a magnetic field is built up around the solenoid coil 16 causing land 19 of solenoid armature 18 to be drawn into the field, causing solenoid armature 18 to be forcibly shifted to the left, toward flexible valve element 34, causing it to bend away from solenoid armature 18, and causing the tip of flexible valve element 34 to swing from its obstruction of flex valve aperture 38, thus allowing the free flow of liquid therethrough. This free flow of liquid causes a significant pressure drop on the fluid in flex valve aperture 38, and the vertical flow channel 40 in connection with it. Vertical flow channel 40 then begins receiving fluid from both cross channel 52, and chamber 51*a*, which is in fluid communication with it, due to the pressure drop caused by the opening of the flex valve aperture 38. Flow restriction 42 prevents the higher pressure supply fluid from rushing into vertical flow channel 40 at a rate high enough to prevent the draining of fluid from chamber 51*a*, and consequently, fluid drains from and fluid pressure drops within chamber 51*a* more rapidly than within chamber 51*b*, causing actuator drive rod 67 to move in the direction of reduced pressure, in this case to the left. Chamber 51*b* is still receiving fluid through the support port 12, supply channel 53, cross channels 52, flow restriction 43, and flow channel 41, which also combines to further urge land 54 and actuator drive rod 67 to the left. It is understood that operation of the valve can be accomplished through a computer or digital controller which may control the time of the duration of the electrical current flow energizing either of the solenoid coils 16 or 17.

Likewise, to move actuator or drive rod 67 to the right, solenoid coil 17 is energized, a magnetic field is build up around the solenoid coil 17 causing land 19 of solenoid armature 18 to be drawn into the field, causing solenoid armature 18 to be forcibly shifted to the right, toward flexible valve element 35, causing it to bend away from solenoid armature 18, and causing the tip of flexible valve element 35 to swing from its osbstruction of flex valve aperture 39, thus allowing the free flow of liquid therethrough. This free flow of liquid causes a significant pressure drop of the liquid in flex valve aperture 39, and the flow channel 41 in connection with it. Flow channel 41 then begins receiving fluid from both cross channel 52, and chamber 51*b*, which are in fluid communication with it, due to the pressure drop caused by the opening of the flex valve aperture 39. Flow restriction 43 prevents the higher pressure supply fluid from rushing into flow channel 41 at a rate high enough to prevent the draining of fluid from chamber 51*b*, and consequently, fluid drains from and fluid pressure drops within chamber 51*b* more rapidly than within chamber 51*a*, causing actuator drive rod 67 to move in the direction of reduced pressure, in this case to the right. Chamber 51*a* is still receiving fluid through the supply port 12, supply channel 53, cross channel 52, flow restriction 42, and vertical flow channel 40, which also combines to further urge land 54 and actuator drive rod 67 to the right.

It is to be understood that a key objective of the present invention is to provide simplicity of design, simplicity of operation, and light weight construction. The invention can be operated using simple direct control, computer assisted control, or computer assisted control with a feed back displacement indicator so that the computer can exercise control in response to the actual position of actuator drive rod 67, or external forces on the actuator drive rod 67. The present invention is especially useful in aircraft and missile control applications where the space and weight limitations will make good use of its simple, light weight construction. It is further understood that the term "fluid" refers to any fluid which has the flow and pressure characteristics of a fluid, whether a liquid or a gas, and is therefore not limited to any particular type of fluid such as a commercial hydraulic fluid. It is especially useful in missile applications where a separate source of hydraulic control fluid, in addition to fuel from the fuel pump, would be prohibitive. The short stroke of the solenoid armature 18 will provide less delay in operation of the invention making response virtually instantaneous.

It is further understood that the size of cross channel 52 and flow restrictions 42 and 43 can be adjusted according to the speed and force necessary to be applied to the travel of actuator drive rod 67.

It is further understood that the present invention will be relatively unaffected by exposure to extreme inertial forces such as those encountered in modern missiles during launch acceleration, or aircraft during sharp turns and coming out of dives, especially due to the light weight of both the flexible valve elements 34 and 35, and solenoid armature 18. It is further understood that the solenoid used in the present invention can be of the type which operates between three quantitized positions, normally fully energized in one direction, fully energized in the opposite direction, and in the neutral un-energized position. It is also understood that the solenoid may be built especially to operate under conditions of timed electrical pulses, or built for operating under conditions of rapid pulsations of current of differing time duration. It is further understood that the point of contact of solenoid armature 18 along the length of flexible valve elements 34 and 35 can be varied, so that the variables, including the size of flex valve apertures 28 and 29, the stroke of solenoid armature 18, the size and strength of solenoid coils 16 and 17, the size of solenoid armature 18 and land 19, and the length, width and springing strength of flexible valve elements 34 and 35, can be adjusted as needed for maximum performance in specific applications.

It will be further understood that the arrangement of the elements of this invention were for the purpose of providing an electro-fluid control valve which is to be as maintenance free and long lasting as possible, and to minimize downtime in the event that a malfunction does occur, by providing quick access and ease of servicing. The resilient flexible valve elements should require little maintenance because they do not wear against the flow channel.

The aforementioned seal drainage channels 46, 47, 64, and 65 placed between sealing surfaces will insure that the present device will not leak into its external environment, and that the electrical actuating assembly 9 will not become fouled by the unwanted invasion of the control fluid.

It is further understood, although this invention may be of the "leaky" type, namely that the flexible valve elements 34 and 35 may allow the passage of small amounts of control fluid even when the invention is in its un-energized state, that differing valve element clearances may be employed such that the leakage may be kept to the minimum necessary, yet provide that the flexible valve elements 34 and 35 make no or minimum contact and thus do not wear or wear very little respectively against valve element support cylinders 26 and 27. Since this leakage may be kept to a minimum, the energy expended in causing control fluid to flow through the device when the device is un-energized may also be kept to a minimum.

While specific embodiments of an electrically controlled fluid driven actuator valve have been disclosed in the foregoing description, it is intended that many modifications and adaptations should and are intended to be comprehended within the meaning and range of this invention, without any such modifications and adaptations causing a departure from the spirit and scope of the invention.

Having described the invention with sufficient clarity that those skilled in the art may make and use it, what is claimed is:

1. An actuator assembly comprising:

means utilizing electric current for producing linear motion;

flexible value means for controlling fluid flow including a valve element support cylinder having an internal bore and an aperture extending transversely through said cylinder in relation to the axis of said internal bore, said aperture opening into said internal bore and operable for carrying the motive fluid flow; and a flexible valve element secured at one end to said support cylinder with an opposite end disposed immediately adjacent said aperture for nomally impeding fluid flow through said aperture to said internal bore, said flexible valve element arranged to withstand longitudinally applied forces while being flexibly displaceable in response to axially directed forces applied by said means for producing linear motion; and a mechanical output member movable in response to the flow of fluid controlled by said flexible valve means.

2. The actuator assembly of claim 1, wherein said means utilizing electric current for producing linear motion is a solenoid coil.

3. The actuator assembly of claim 1, wherein said mechanical output member further comprises:

an actuator drive rod having two ends, each end of which extends externally from within said actuator assembly, said actuator drive rod having a radially enlarged land between said ends, said land to abut on inner surface of said actuator assembly to block the passage of said fluid from one side of said land to the other, said land then to enable said actuator drive rod to become linearly displaced in response to said fluid flow.

4. The actuator assembly of claim 1 wherein said means for producing linear motion is operable to axially shift said flexible valve element.

5. The actuator assembly of claim 1 wherein said mechanical output member is a fluid operated piston.

6. The actuator assembly of claim 5 wherein said piston is a double acting piston and cylinder assembly.

7. An actuator assembly comprising:

a housing;

a pair of solenoid coils within said housing;

a solenoid armature, located between and coaxial with said pairs of solenoid coils;

a flexible valve element perpendicularly abutting the end of said solenoid armature;

a valve element support cylinder having an aperture, the axis of said aperture coaxial with the axis of said flexible valve element; and, an actuator drive rod slidably mounted within a chamber located within said housing, said housing having a channel which allows fluid communication between the aperture of said valve element support cylinder and said chamber located within said housing in which said actuator drive rod is slidably mounted; said housing also having a channel which allows fluid communication between said chamber located within said housing in which said actuator drive rod is slidably mounted, and any source of fluid desired for use in said actuator assembly.

8. An actuator assembly comprising:

a body, having a cavity formed therein, and also having an actuator chamber formed therein;

a solenoid assembly mounted within said cavity, capable of converting an electric current signal to a mechanical translating motion;

a valve having a flexible valve element in shearing engagement with an aperture in the wall of a valve element support cylinder, openable by said solenoid assembly; and an actuator drive rod in said chamber movable in response to fluid pressure in said chamber, said valve in fluid communication with said actuator chamber.

9. The actuator assembly of claim 8 wherein:

said valve has a valve element support cylinder, and a flexible valve element, wherein one end of said flexible valve element is enlarged to be flexibly attached to an inner surface of said valve element support cylinder, and the other end of said flexible valve element has an end surface area which impedes fluid flow through fluid said fluid aperture in communication with said actuator chamber when the flexible valve element is in the unflexed position, said flexible valve element to allow the flow of fluid through said aperture when said flexible valve element is in the flexed position.

10. The assembly of claim 9 wherein:

said solenoid operating positions are stable at discrete positions of energization and un-energization.

11. The assembly of claim 8 wherein:

said solenoid operating positions are stable at discrete positions of energization and un-energization.

12. A method for actuating a device comprising the steps of:

energizing an electric solenoid coil to form a magnetic field around said coil;

drawing a solenoid armature into the magnetic field by the attraction of ferrous material on the armature to the magnetic field;

flexing a flexible cantilevered valve element in response to movement by and contact with said solenoid armature;

opening a fluid port located adjacent to the tip end of said flexible valve element, upon said flexing of said flexible valve element and resultant movement of its tip end away from an obstructing position adjacent to said fluid port, to permit relatively unobstructed fluid flow therethrough; and driving a fluid operated mechanical actuator in response to a fluid imbalance created by said opening of the fluid port.

13. A method as set forth in claim 12, further including the step of utilizing the inherent spring force of said cantilevered valve element to return said valve element and said armature to a null position upon de-energizing said solenoid coil.

14. An actuator assembly comprising:

a body having a central cavity, open at one end;

an electrical actuating assembly mounted in said central cavity, having a plurality of axially displaced solenoid coils, the axis of said solenoid coils being coaxial with the axis of said central cavity, and said armature, mounted axially within said solenoid coils, having a land formed at the center of, and integral with said solenoid armature, such that said land is located axially between said solenoid coils such that energization of one of said solenoid coils will pull said solenoid armature axially toward said coil, said electrical actuating assembly further having a pair of plates, each axially outside of and abutting said solenoid coils, said plates each having a center hole for said solenoid armature to extend therethough, said plates having a multiplicity of bolts joining said plates and sandwiching said solenoid coils therebetween to complete said electrical actuating assembly, said electrical actuating assembly further having a multiplicity of wires connected to said solenoid coils to effect energization of said solenoid coils, said multiplicity of wires extending from said electrical actuating assembly out of said body through an electrical command port formed integrally with said body;

a pair of valve element support cylinders, each having an open end, disposed axially on each side of said plates with said open ends disposed away from said plates, each said valve element support cylinder having an aperture near the center of the closed end for the ends of said solenoid armature to extend therethrough;

a pair of seals in each retaining wall located within said aperture to form a slidable sealing engagement with said solenoid armature to prevent the passage of fluid therebetween;

a pair of flexible valve elements having an enlarged base at one end, and a tip at the other end, said enlarged base fixably attached to the curved inside wall of said valve element support cylinder, the midpoint of said flexible valve elements each perpendicularly abutting one end of said solenoid armature, such that longitudinal movement of said solenoid armature toward said flexible valve element will cause said flexible valve element to bend away from said solenoid armature, said flexible valve elements each traversing the inside diameter of said valve element support cylinder such that said tip of said flexible valve element is in coaxial blocking alignment with a flex valve aperture formed in the wall of said valve element support cylinder, such that when the flexible valve element is in its linear unflexed position, the flow of fluid entering the space within said valve element support cylinder is thereby impeded, and such that when the flexible valve element is in its flexed position, the opening of said flex valve aperture is unblocked such that the flow of fluid entering the space within said valve element support cylinder is facilitated;

an end cap, enclosing said central cavity open at one end and sealingly engaged with said body, to enclose said electrical actuating assembly and said valve element support cylinders within said body;

said body also having a pair of flow channels in coaxial alignment and communication with said flex valve aperture, said body also having a cylindrically shaped actuator cavity in communication with said pair of flow channels, one of said flow channels in communication with one end of said cylindrically shaped actuator cavity, and the other of said flow channels in communication with the other end of said cylindrically shaped actuator cavity;

an actuator drive rod having two ends, each end of which is extended through and in slidable, sealing connection with one of a pair of body apertures formed in said body, each end of said actuator drive rod extending through and disposed outside of said body, said actuator drive rod having a radially enlarged land between said ends, the perimeter surface of said land in slidable sealing engagement with the wall of said upper actuator cavity, thereby dividing said upper actuator cavity into a left chamber and a right chamber, said left chamber and said right chamber prevented from direct fluid communication with each other within said actuator cavity by the presence of said land, said body further containing across channel, communicating with both said flow channels, and said cross channel having a pair of flow restriction orifices near each end of said cross channel, said body further containing a supply port, formed integrally with said body, said supply port in fluid communication with a point near the center of said cross channel, to allow incoming fluid to flow into said cross channel, then through either restriction orifice and into one of said flow channels, and then into either said left chamber or said right chamber, to urge said actuator drive rod to the right or to the left respectively, said body further containing a return port formed integrally with said body, in fluid communication with said valve element support cylinders, to return fluid therefrom; and seals on points of sealing, slidable engagement between said actuator drive rod and said body, and between said solenoid armature and said valve element support cylinders, said body further containing drainage channels, formed integrally with said body, in communication with annular spaces formed between said seals, in order to collect and drain any seepage fluid seeping past said seals, said body further containing drainage port, formed integrally with said body, in communication with said drainage channels to pass seepage fluid outside of said body.

15. A valve comprising:

a body having a bore, said body also having a fluid passage in the wall of said body, and opening into said bore;

a flexible valve element having a fixed end and a tip end, said tip end immediately adjacent said opening of said fluid passage into said bore, so situated to blockingly engage fluid entering said bore through said fluid passages, cantilevered to said body at said fixed end within said bore; and a driver capable of abuting said flexible valve element and capable of deflecting said tip end of said flexible valve element away from blocking engagement with fluid entering said bore through said fluid passage.

16. The valve of claim 15 wherein said bore extends completely through said body.

17. A method for actuating a device comprising the steps of:

energizing a solenoid coil;

magnetically displacing a solenoid amrature associated with said solenoid coil;

deflecting a flexible valve element, associated with said solenoid armature away from the aperture of a valve element support cylinder; and unbalancing the pressure on the sides of an actuator drive rod, utilizing said deflection of said flexible valve element, to drive said actuator drive rod.

18. An actuator assembly comprising:

solenoid means having an armature axially disposed within a pair of coils, the armature including an enlarged central land disposed between the coils;

means to individually energize said pair of solenoid coils to axially displace said armature in the direction of the one of said pair of solenoid coils which are energized;

a pair of flexible valve elements operably associated with said solenoid means, one of said pair of flexible valve elements operably disposed to flex upon movement of said armature in one axial direction and the other of said pair of flexible valve elements generally disposed to flex upon movement of said armature in the other axial direction;

actuator means operably associated with said solenoid means and said pair of flexible valve elements, said actuator means having a double acting piston and cylinder means including an actuator drive rod; and fluid pressure means responsive to the position of said pair of flexible valve elements to provide fluid pressure to said actuator means to move said actuator drive rod.

19. The actuator assembly of claim 18 further comprising:

flow restriction means in said fluid pressure means to promote fluid drainage from the lower pressure side of said double acting piston and cylinder means.

* * * * *